United States Patent [19]

Totani

[11] Patent Number: 4,505,699

[45] Date of Patent: Mar. 19, 1985

Best Available Copy

[54] APPARATUS FOR MAKING ENVELOPES FROM A CONTINUOUS FILM SHEET

[75] Inventor: Mikio Totani, Muko, Japan

[73] Assignee: Totani Giken Kogyo Kabushiki Kaisha, Kyoto, Japan

[21] Appl. No.: 354,334

[22] Filed: Mar. 3, 1982

[51] Int. Cl.[3] ..... B31B 1/26; B65H 35/10

[52] U.S. Cl. ..... 493/196; 493/248; 493/369

[58] Field of Search ..... 493/193–197, 493/198, 369, 235, 231, 248, 440, 439

[56] References Cited

U.S. PATENT DOCUMENTS

| | | | |
|---|---|---|---|
| 2,435,560 | 2/1948 | Richens | 493/194 |
| 2,444,685 | 7/1948 | Waters | 493/196 |
| 2,873,566 | 2/1959 | Sylvester et al. | 493/196 X |
| 3,433,136 | 3/1969 | Hartbauer et al. | 493/196 |
| 3,512,457 | 5/1970 | Watanabe | 493/194 X |
| 4,055,109 | 10/1977 | Kan | 493/196 |

FOREIGN PATENT DOCUMENTS

| | | | |
|---|---|---|---|
| 89148 | 7/1980 | Japan . | |
| 909075 | 10/1962 | United Kingdom | 493/194 |

*Primary Examiner*—James F. Coan

*Attorney, Agent, or Firm*—Morgan, Finnegan, Pine, Foley & Lee

[57] ABSTRACT

A continuous film sheet having a width in a horizontal direction is unwound from a film roll with its axis being substantially horizontally kept. The direction of extension of the film sheet is changed so as to have its width in a vertical direction before the film sheet is slit along its center line into two continuous strips. The two continuous strips are superposed on each other and heat-sealed in lengthwise and transverse directions to form a plurality of rectangular sections defined by heat-sealed sides. The heat-sealed sheet is then slit and cut into separated envelopes having their respective three heat-sealed edges.

5 Claims, 5 Drawing Figures

APPARATUS FOR MAKING ENVELOPES FROM A CONTINUOUS FILM SHEET

BACKGROUND OF THE INVENTION

This invention relates to apparatus for making envelopes from a continuous film sheet.

It is known to automatically and continuously make a large number of envelopes from a continuous film sheet by unwinding a continuous film from a film roll, slitting the continuous film sheet into two continuous strips, superposing the two slitted strips on each other, heat-sealing the superposed strips in lengthwise and transverse directions to form a plurality of rectangular sections defined by heat-sealed sides, and slitting and cutting the heat-sealed sheet into separated envelopes having their respective three heat-sealed edges. Usually a continuous film sheet is fed with its width being kept in a vertical direction to a slitting station where the continuous film sheet is slit into two continuous strips which are then superposed on each other with their planes of extension being substantially horizontally kept for heat-sealing operation. In order to unwind a continuous film sheet so as to keep its width in a vertical direction, the axis of the film roll must be supported vertically. The vertical support of the film roll axis is unstable and makes it difficult to smoothly unwind a continuous film sheet from the roll. Another disadvantage of the vertical support of the film roll axis lies in the fact that it is extremely difficult to adjust the position of the film roll during the unwinding operation in such a manner that the center line of the unwound film sheet is always maintained so as to be aligned with the level of the slitting knife which is supported at a fixed position for slitting the film sheet.

One of the objects of the invention is to provide an improved system for making envelopes from a continuous film sheet in which the above mentioned defects and disadvantages of the prior art can be avoided.

Another object of the invention is to provide a new system for supplying a continuous film sheet from a film roll to a slitting station for slitting the film sheet into two continuous strips in which the film roll axis is horizontally supported while in the slitting station the film sheet supplied has its width in a vertical direction.

A further object of the invention is to provide an improved means for shifting the film sheet during the feeding operation so that the center line of the film sheet supplied is always maintained so as to be aligned with the level of the slitting knife mounted in a fixed position.

A still another object of the invention is to provide an improved heat-sealing system for making envelopes from a continuous film sheet whereby undesirable deformation of the heat-sealed product due to the greater heat shrinkage on one surface thereof can be avoided.

Other objects of the invention will partly be apparent and partly become clear from the following detailed description.

SUMMARY OF THE INVENTION

Apparatus for making envelopes from a continuous film sheet according to the invention comprises means for supporting a film roll with its axis being substantially horizontally kept so as to unwind therefrom a continuous film sheet having a width in a horizontal direction, means for changing the direction of extension of the film sheet continuously unwound from said film roll so as to have its width in a vertical direction, means for slitting the film sheet having its width in a vertical direction along its center line into two continuous strips, means for changing the forwarding directions of said two continuous strips so as to be superposed on each other with their planes of extension being substantially horizontally kept, means for heat-sealing said superposed strips in lengthwise and transverse directions to form a plurality of rectangular sections defined by heat-sealed sides, and slitting and cutting the heat-sealed sheet into separated envelopes having their respective three heat-sealed edges.

According to the invention, since the film roll is substantially horizontally supported, a continuous film sheet can be smoothly unwound from the film roll in addition to the fact that exchange of the film roll can be easily done.

In a preferred embodiment of the invention means for changing the direction of extension of the film sheet unwound from the film roll comprises a slant plate having a slanting guide edge. The slant plate is vertically arranged and means is provided for adjusting the position of said slant plate in a vertical direction. In this manner, a continuous film sheet having a width in a horizontal direction can properly change its direction of extension so as to have its width in a vertical direction before reaching the slitting station. Adjustment of the position of the slant plate in a vertical direction is carried out during the operation of feeding the film sheet. This is important to always maintain the film sheet supplied in such a manner that the center line of the film sheet is aligned with the level of the slitting knife. In this connection, it will be understood that, according to the invention, it is not necessary to move the film roll during the unwinding operation.

Preferably, means for slitting the film sheet along its center line into two continuous strips comprises a slitting knife to slit the film sheet and a V-shaped plate having two slanting guide edges intersecting to each other in a position at the same level as the slitting knife, said two slanting guide edges guiding said two separated strips in opposite directions.

Means for changing the forwarding directions of said two continuous strips so as to be superposed on each other may preferably include a pair of dancer rollers which engage with said two separated strips to absorb any loosening lengths, respectively, said pair of dancer rollers being operatively connected to each other to ensure the same feeds for the two separated strips.

Means for heat-sealing said superposed strips in lengthwise directions may preferably comprise a plurality of lengthwise extending sealing knives arranged in a spaced relationship with predetermined width intervals, each adjoining two sealing knives for lengthwise heat-sealing being engageable with said superposed strips from the opposite sides, respectively. Means for heat-sealing said superposed strips in transverse directions may also comprise a plurality of transversely extending sealing knives arranged in a spaced relationship with predetermined length intervals, each adjoining two transverse sealing knives being engageable with said superposed strips from the opposite sides, respectively.

DETAILED DESCRIPTION OF THE INVENTION

Figures 1, 2:
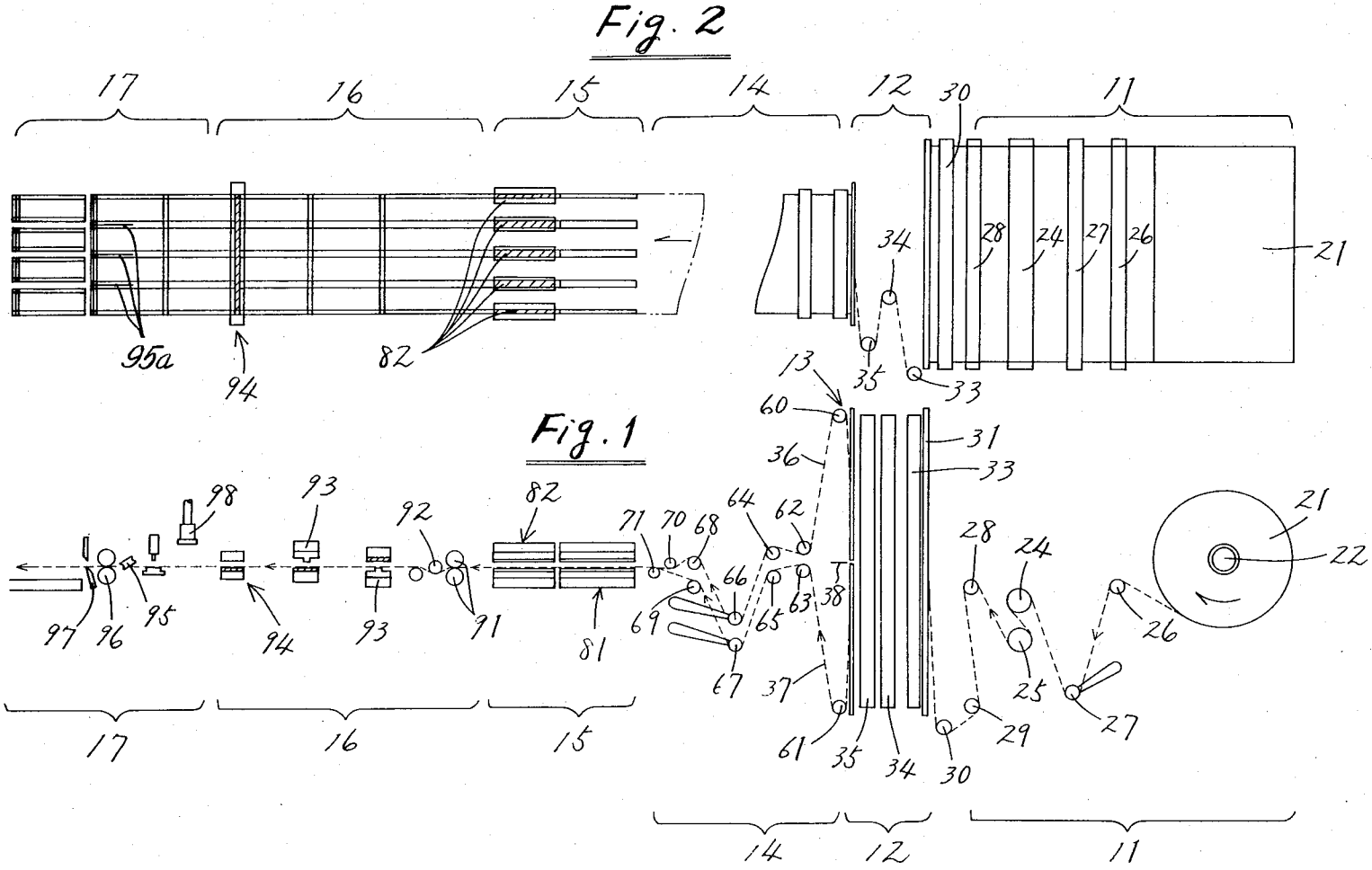
FIG. 1 is a schematic front view, showing the whole system of an embodiment of the present invention.
FIG. 2 is a schematic plan view of the system illustrated in FIG. 1.

Referring to the drawings, especially FIGS. 1 and 2, there is schematically shown the whole system of apparatus for making envelopes from a continuous film sheet according to the invention. The system essentially comprises the unwinding station 11, the folding station 12, the slitting station 13, the superposing station 14, the lengthwise sealing station 15, the transverse sealing station 16, and the slitting and cutting station 17.

Figure 3:
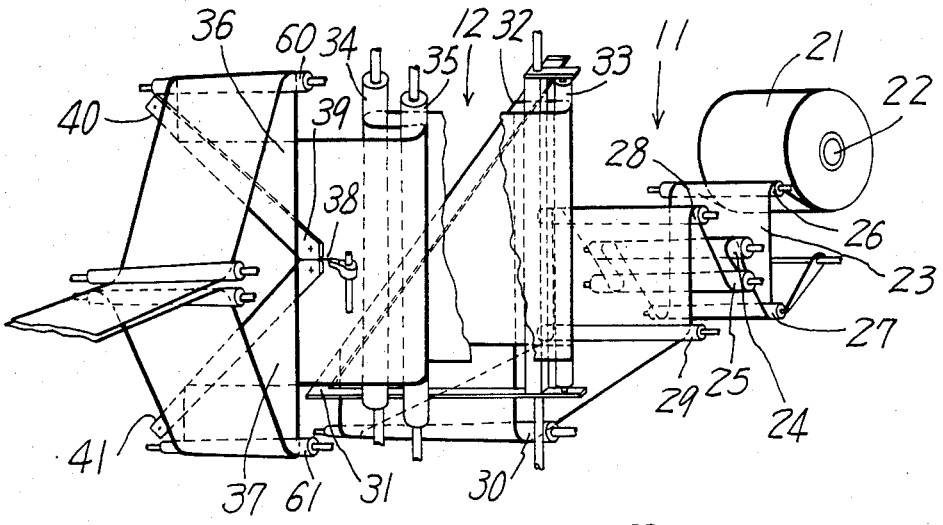
FIG. 3 is a perspective view of the first part of the system illustrated in FIGS. 1 and 2.

The first part of the system including the unwinding station 11, the folding station 12 and the slitting station 13 is more clearly illustrated in FIG. 3. Referring to FIGS. 1, 2 and 3, according to the invention, a film roll 21 is substantially horizontally supported. Namely, the axis 22 lies in a horizontal direction. A continuous film sheet 23 is unwound by the drive of rubber drawing rollers 24, 25 through a guide roller 26 and a dancer roller 27 from the film roll 21. The dancer roller 27 absorbs any loosening length. The continuous film sheet 23 is fed through guide rollers 28, 29, 30 to the folding station 12. In this unwinding stage, the continuous film sheet supplied has a width in a horizontal direction.

Figure 4:
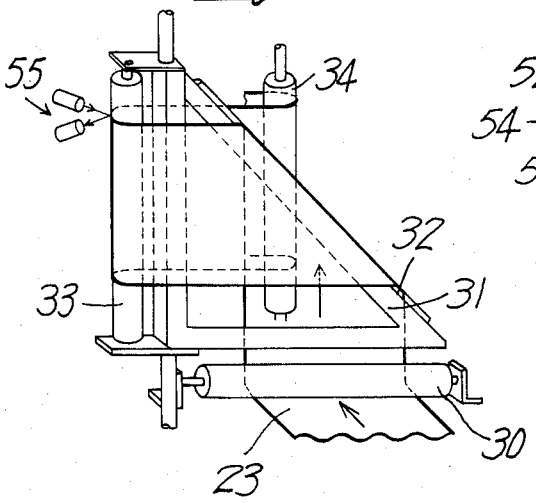
FIG. 4 is a perspective view of means for changing the direction of extension of the film sheet continuously supplied.

In the folding station 12 the direction of extension of the film sheet is changed so as to have its width in a vertical direction. Means for changing the direction of extension of the film sheet according to the invention comprises a slant plate 31 having a slanting guide edge 32. This means is more clearly illustrated in FIG. 4. Referring to FIGS. 3 and 4, the continuous film sheet 23 fed to the slant plate 31 is folded with an angle of 45° by the guide of the slanting guide edge 32. In this manner, the direction of extension of the film sheet is changed so as to have its width in a vertical direction. The continuous film sheet having its width in a vertical direction is then fed to the slitting station 13 through guide rollers 33, 34, 35.

In the slitting station 13 the film sheet having its width in a vertical direction is slitted along its center line into two continuous strips 36, 37. The slitting device comprises a slitting knife 38 and a V-shaped plate 39 having two slanting guide edges 40, 41 intersecting to each other in a position at the same level as the slitting knife 38. The slitting knife 38 slits the film sheet along its center line into two continuous strips 36, 37 and the two slanting guide edges 40, 41 guide the two separated strips 36, 37 toward opposite directions, namely, upwardly and downwardly as illustrated in FIG. 3.

Figure 5:
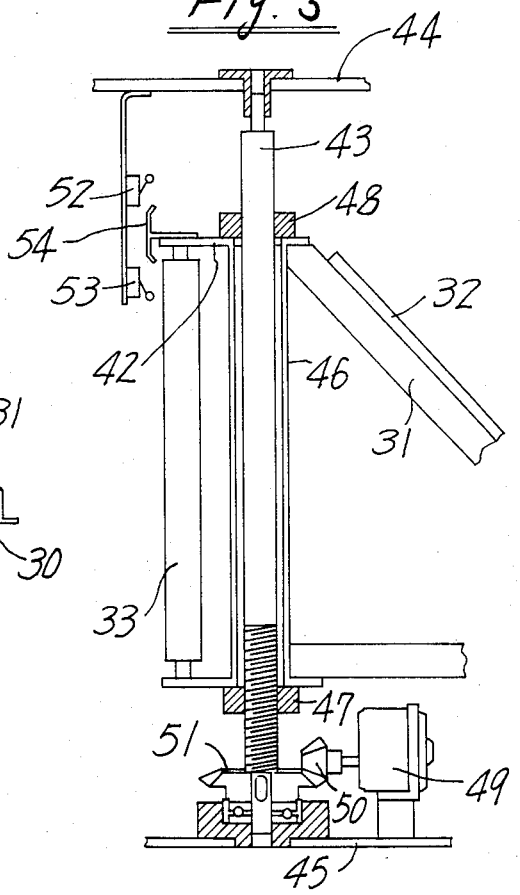
FIG. 5 is a front view partly in section of means for adjusting the position of the slant plate illustrated in FIG. 4.

According to the invention, in order to maintain the center line of the film sheet supplied so as to be aligned with the level of the slitting knife 38 mounted in a fixed position, means is provided for shifting the film sheet during the feeding operation. The shifting of the film sheet may preferably be carried out by adjusting the position of the slant plate 31 in a vertical direction. Means for adjusting the position of the slant plate 31 is illustrated in detail in FIG. 5. Referring to FIG. 5, a frame 42 supporting the slant plate 31 and the guide roller 33 is mounted on a vertical shaft 43. The vertical shafe 43 is rotatably supported between the upper and the lower ground frames 44, 45 and extend through an elongated sleeve 46 which is formed in the frame 42. The lower portion of the vertical shaft 43 is screw-threaded and engages with a female screw-threaded guide piece 47 fixed to the frame 42 at the lower end of the sleeve 46. At the top end of the sleeve 46 another guide piece 48 fixed to the frame 42 slidably engages with the vertical shaft 43. In this manner, when the shaft 43 is rotated, the frame 42 is moved vertically. Rotation of the vertical shaft 43 is driven by a motor 49 through gears 50, 51. The extent of vertical movement of the frame 42 is restricted by a pair of limit switches 52,53. The reference numeral 54 indicates a limit kicker fixed to the frame 42 and engageable with the limit switches 52, 53.

Any displacement in a vertical direction of the continuous film sheet after leaving the slant plate 31 is preferably detected at the position of the guide roller 33. For this purpose, photoelectric detecting means 55 (FIG. 4) is provided. Photoelectric detecting means may be of any known type and may comprises a light projector and a photoelectric cell. Photoelectric detecting means detects any displacement of the continuous film sheet in a vertical direction at any printed marks on the film sheet at its center line position or near its one edge. In case where the continuous film sheet has no mark for detecting, displacement of the film sheet in a vertical direction may be detected by photoelectric detecting means at one of the edges of the film sheet on the guide roller 33. The electric signal which is produced at the photoelectric detecting means is forwarded to the control motor 49 for vertically driving the slant plate 31 until the film sheet on the guide roller 33 reaches a predetermined level. In this manner, the continuous film sheet unwound from an unevenly wound film roll can always be maintained in a proper level for slitting after leaving the slant plate.

The two continuous film strips 36, 37 leaving the respective slanting guide edges 40, 41 change their forwarding directions at the positions of the rollers 60, 61 and then are fed to the superposing station 14. In the superposing station 14 the two continuous film strips 36, 37 are superposed on each other with their planes of extension being horizontally kept after running through a number of guide rollers 62, 64, 66, 68, 70; 63, 65, 67, 69, 71. Rollers 66, 67 are dancer rollers for absorbing any loosening lengths of the two strips, respectively. Preferably, the two dancer rollers are operatively connected to each other to ensure the same feeds for the two separated strips. The positions of the two dancer rollers may be detected for automatically controlling the drawing speed of the drawing rollers 24, 25.

The superposed strips leaving the superposing station is forwarded to the lengthwise sealing station 15. In this station the superposed strips are heat-sealed in lengthwise directions. Means for heat-sealing in lengthwise directions comprises a plurality of lengthwise extending sealing knives 81 arranged in a spaced relationship with predetermined width intervals. Each adjoining two sealing knives 81 are engageable with the superposed strips form the opposite sides, respectively. In this manner, the sealed product can be prevented from being waved in a transverse direction due to a greater shrinkage on one side of the superposed strips. The reference numeral 82 indicates a number of lengthwise cooling means in positions immediately after the respective sealing knives 81.

The lengthwise heat-sealed product is drawn by a pair of rubber rollers 91 and then forwarded to the transverse sealing station 16. The lengthwise heat-sealed product may preferably be entered into the transverse sealing station 16 after being controlled at a constant tension by a tension roller 92.

In the transverse sealing station 16 the lengthwise sealed product is further heat-sealed in transverse directions. Means for heat-sealing in transverse directions comprises a plurality of transversely extending sealing knives 93 arranged in a spaced relationship with predetermined length intervals. Each adjoining transverse sealing knives 93 are engageable with the superposed strips from the opposite sides, respectively. In this manner, the heat-sealed product can be prevented from being waved in a lengthwise direction due to a greater shrinkage on one side of the superposed strips. The reference numeral 94 indicates cooling means at a position after the last sealing knife 93.

The heat-sealed product after leaving the transverse sealing station 16 forms a plurality of rectangular sections defined by heat-sealed sides. This heat-sealed product is forwarded to the slitting and cutting station 17 where the heat-sealed product is slit in lengthwise directions and then cut in a transverse direction. The reference numeral 95 indicates means for slitting which has a plurality of knives 95*a* each of which slits the heat-sealed product at a center line of each lengthwise sealing zone. The reference numeral 96 indicates a pair of drive rollers and the reference numeral 97 indicates shearing means for cutting the sealed product in a transverse direction. The sealed product is cut along one edge of each transverse sealing zone so that openings are formed therealong to form a number of envelopes each having three heat-sealed edges and one opening edge. The reference numeral 98 indicates an image sensor for watching the feeding of the heat-sealed product and producing signals for controlling the feeding length.

What I claim is:

1. Apparatus for making envelopes from a continuous film sheet comprising:

means for supporting a film roll with its axis being substantially horizontally and kept so as to unwind therefrom as a continuous film sheet having a width extending in a horizontal direction, means for changing the direction of extension of said width of the film sheet continuously unwound from said film roll so as to have said width in a vertical direction, said direction changing means comprising a vertically disposed slant plate having a slanting guide edge engaging said film sheet for changing the course of movement of the film sheet, and thereby the direction of extension of said width of the film sheet, means for slitting the film sheet having its width extending in a vertical direction along its center line into two continuous strips, means for adjusting the position of said slant plate in a vertical direction to maintain the center line of the film sheet having its width extending in a vertical direction aligned with said slitting means, means for changing the forwarding directions of said two continuous strips so as to be superposed on each other with their planes of extension being substantially horizontally kept, means for heat-sealing said superposed strips in lengthwise and transverse directions to form a plurality of rectangular sections defined by heat-sealed sides, and means for slitting and cutting the heat-sealed sheet into separated envelopes having their respective three heat-sealed edges.

2. Apparatus for making envelopes from a continuous film sheet as defined in claim 1 in which means for heat-sealing said superposed strips in lengthwise directions comprises a plurality of lengthwise extending sealing knives arranged in a spaced relationship with predetermined width intervals, each adjoining two sealing knives for lengthwise heat-sealing being engageable with said superposed strips from the opposite sides, respectively.

3. Apparatus for making envelopes from a continuous film sheet as defined in claim 1 in which means for heat-sealing said superposed strips in transverse directions comprises a plurality of transversely extending sealing knives arranged in a spaced relationship with predetermined length intervals, each adjoining two transverse sealing knives being engageable with said superposed strips from the opposite sides, respectively.

4. Apparatus for making envelopes from a continuous film sheet as defined in claim 1 in which said means for slitting the film sheet along its center line into two continuous strips comprises a slitting knife to slit said film sheet and a V-shaped plate having two slanting guide edges intersecting to each other in a position at the same level as said slitting knife, said two slanting guide edges guiding said two separated strips in opposite directions.

5. Apparatus for making envelopes from a continuous film sheet as defined in claim 1 in which said means for changing the forwarding directions of said two continuous strips so as to be superposed on each other includes a pair of dancer rollers which engage with said two separated strips to absorb any loosening lengths, respectively, said pair of dancer rollers being operatively connected to each other to ensure the same feeds for the two separated strips.

* * * * *